US011084696B2

(12) United States Patent
Girard

(10) Patent No.: US 11,084,696 B2
(45) Date of Patent: Aug. 10, 2021

(54) LIFT TABLE FOR REPAIRING AND SERVICING A WHEELED VEHICLE, IN PARTICULAR WITH TWO WHEELS

(71) Applicant: MAROLOTEST, Cholet (FR)

(72) Inventor: Raphaël Girard, Saint Germain sur Moine (FR)

(73) Assignee: MAROLOTEST, Cholet (FR)

( * ) Notice: Subject to any disclaimer, the term of this patent is extended or adjusted under 35 U.S.C. 154(b) by 374 days.

(21) Appl. No.: 16/304,857

(22) PCT Filed: May 3, 2017

(86) PCT No.: PCT/FR2017/051062
§ 371 (c)(1),
(2) Date: Nov. 27, 2018

(87) PCT Pub. No.: WO2017/207882
PCT Pub. Date: Dec. 7, 2017

(65) Prior Publication Data

US 2020/0325009 A1 Oct. 15, 2020

(30) Foreign Application Priority Data

Jun. 1, 2016 (FR) ..... 16 54970

(51) Int. Cl.
*B66F 7/06* (2006.01)
*B66F 7/08* (2006.01)

(52) U.S. Cl.
CPC ..... *B66F 7/065* (2013.01); *B66F 7/08* (2013.01); *B66F 7/085* (2013.01)

(58) Field of Classification Search
CPC .. B66F 7/065; B66F 7/085; B66F 7/28; B66F 7/08; B60P 3/06; B60P 3/07; B60P 3/122; B25H 1/0014
USPC ..... 254/91, 93 L, 122, 88
See application file for complete search history.

(56) References Cited

U.S. PATENT DOCUMENTS 5,570,898 A 11/1996 Albert
5,735,410 A 4/1998 Kallstrom
6,345,693 B1 2/2002 Yeo et al.
(Continued)

FOREIGN PATENT DOCUMENTS

CN 201737650 2/2011
CN 203461772 3/2014

OTHER PUBLICATIONS

"What is Rotational Moulding?" (Apr. 3, 2016), <https://web.archive.org/web/20160403234201/http://www.rotationalmoulding.ca/> (Year: 2016).*

(Continued)

*Primary Examiner* — Lee D Wilson
*Assistant Examiner* — Seahee Hong

(57) ABSTRACT

The invention relates to a lift table (1) for repairing and maintaining a vehicle, in particular a two-wheeled vehicle, said table (1) comprising a table top (2) surmounted by a wheel clamp (3) comprising two opposing jaws (4), between which one of the wheels of the vehicle is suitable for being clamped when the vehicle is in the state of being arranged on the table top (2), and a device (5) for driving upwards and downwards movement of said table top (2).
The table top (2) and at least the surface of the wheel clamp (3) are made out of electrically-insulating material.

9 Claims, 3 Drawing Sheets

(56) References Cited

U.S. PATENT DOCUMENTS

| | | | | |
|---|---|---|---|---|
| 7,278,647 | B1 * | 10/2007 | Keenan | B60S 13/00 280/79.11 |
| 10,005,649 | B2 * | 6/2018 | Liu | B66F 7/28 |
| 2003/0061959 | A1 * | 4/2003 | Johnson | B60S 13/02 104/44 |
| 2005/0077505 | A1 * | 4/2005 | Thurm | B66F 7/08 254/89 H |
| 2008/0156589 | A1 * | 7/2008 | Marchand | B66F 7/085 187/219 |
| 2009/0100613 | A1 * | 4/2009 | Igwemezie | B66F 7/243 14/69.5 |
| 2015/0251884 | A1 | 9/2015 | Kelly et al. | |

OTHER PUBLICATIONS

International Search Report dated Feb. 14, 2017.

* cited by examiner

LIFT TABLE FOR REPAIRING AND SERVICING A WHEELED VEHICLE, IN PARTICULAR WITH TWO WHEELS

RELATED APPLICATION

This application is a National Phase of PCT/FR2017/051062, filed on May 3, 2017, which claims the benefit of priority from French Patent Application No. 16 54970, filed on Jun. 1, 2016, the entirety of which are incorporated by reference.

FIELD OF THE INVENTION

The invention relates to a lift table for repairing and maintaining a wheeled vehicle, in particular a two-wheeled vehicle.

It relates more particularly to a lift table comprising a table top surmounted by a wheel clamp comprising two opposing jaws, between which one of the wheels of the vehicle is suitable for being clamped when the vehicle is in the state of being arranged on the table top, and a device for driving upwards and downwards movement of said table top.

PRIOR ART

The design of a lift table of the above-mentioned type is known as shown in document CN201737650.

The development of high-powered or hybrid two-wheeled vehicles leads to the presence, on such two-wheeled vehicles, of an electric motor that uses high voltage.

Such a two-wheeled vehicle is generally held on the maintenance lift table on which it is placed by means of a metal stabilizer or a metal wheel clamp. The body of a technician, who acts on such a two-wheeled vehicle, tends to press against the lift table. There thus exists a risk of injury to the technician by electric shock, in the event of a short circuit, or of unintentional contact of electric wires or other electrical problems on the wheeled vehicle.

OBJECT AND SUMMARY

An object of the invention is therefore to provide a lift table designed to make it possible to limit the risks of electric shock for the technician acting on an electric wheeled vehicle placed on the lift table.

To this end, the invention provides a lift table for repairing and maintaining a vehicle, in particular a two-wheeled vehicle, said table comprising a table top surmounted by a wheel clamp comprising two opposing jaws, between which one of the wheels of the vehicle is suitable for being clamped when the vehicle is in the state of being arranged on the table top, and a device for driving upwards and downwards movement of said table top, the lift table being characterized in that the table top and at least the surface of the wheel clamp are made out of electrically-insulating material.

In an embodiment of the invention, the electrically-insulating material of the jaws of the wheel clamp is an elastically-deformable material in order to enable the wheel to be held between the jaws of the clamp by resilient clamping. In addition, this results in reduced cost for the lift table and provides an easy solution for avoiding the presence of additional clamping parts.

In an embodiment, the jaws of the clamp are mounted on said table top in removable manner. This makes it possible to replace a jaw easily in the event of damage.

In an embodiment of the invention, each jaw can be adjusted on the table top in order to provide positioning that is variable along the longitudinal axis of the table top and/or spacing that is variable between said jaws.

This makes it possible to receive wheeled vehicles having wheel widths and/or wheel bases that may vary over a wide range.

In an embodiment, at least some of the surfaces facing the jaws are sloping so as to converge towards the table top that they surmount.

In an embodiment, beside the top face for receiving the vehicle, the table top presents a middle longitudinal strip corresponding to the tire tread of the vehicle shaped to form a non-slip surface. This middle longitudinal strip can be made to be removable.

In an embodiment, the electrically-insulating material constituting the table top and/or the wheel clamp is selected from a group made up of polyolefins, polyamides, vinyl polymers, and polyesters.

In an embodiment, the table top and the jaws of the clamp are each molded parts, preferably made using rotational molding or thermoforming.

In an embodiment, the device for driving upwards and downwards movement of said table top includes means for raising the table top associated with at least one pneumatic actuator. The presence of a pneumatic actuator to replace a conventional electrical or electro-hydraulic system again limits the risk of electric shocks.

In an embodiment, the raising means comprise at least one pair of arms, connected together by a pivot connection, the arms of each pair of arms each extending between the under face of the table top and a base that is positioned in register with the table top, and the pneumatic actuator is an air cushion extending in the inflated state on either side, i.e. both above and below, the pivot connection of the arms of the pair(s) of arms.

In an embodiment, beside the top face for receiving the vehicle, the table top presents at least one housing formed by an opening made in said table top. Such a housing may be used by the technician as storage or other means.

BRIEF DESCRIPTION OF THE DRAWINGS

The invention can be well understood on reading the following description of embodiments made with reference to the accompanying drawings.

DETAILED DESCRIPTION

Figure 1:
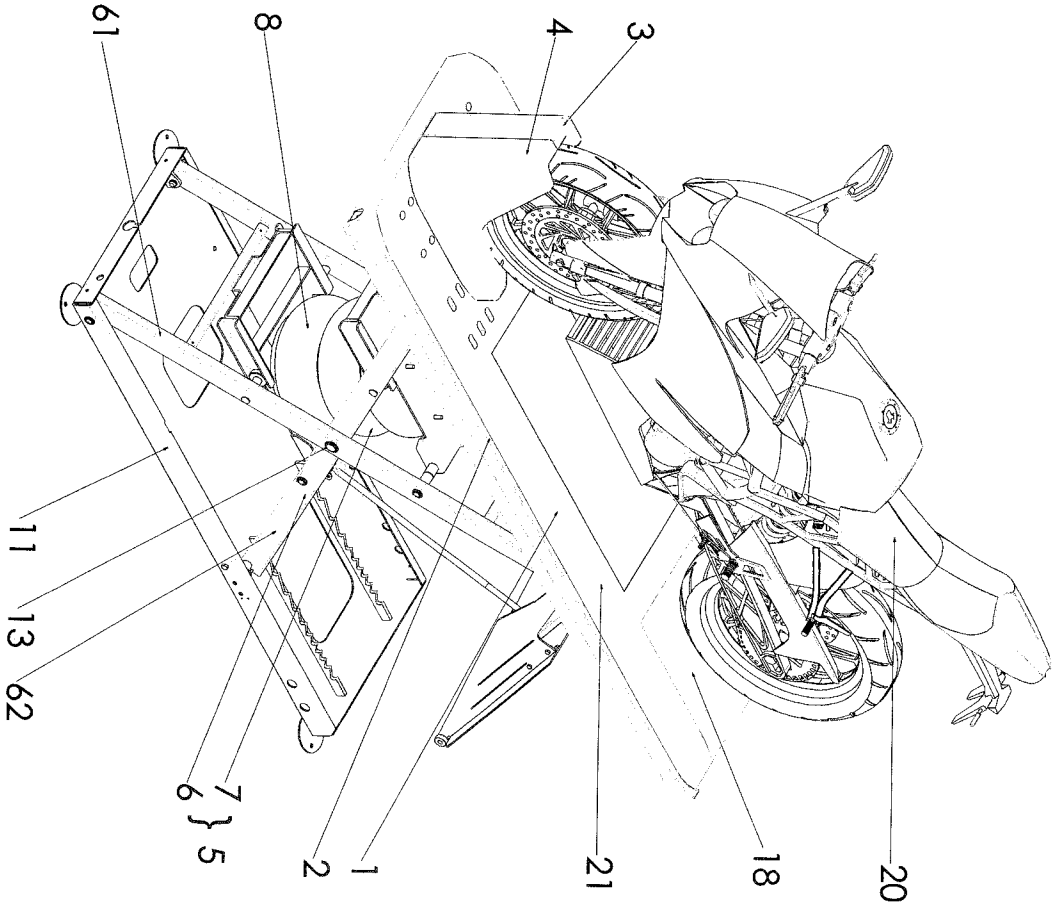
FIG. 1 is an overall view of a lift table of the invention, in its in-use configuration.
Figure 2:
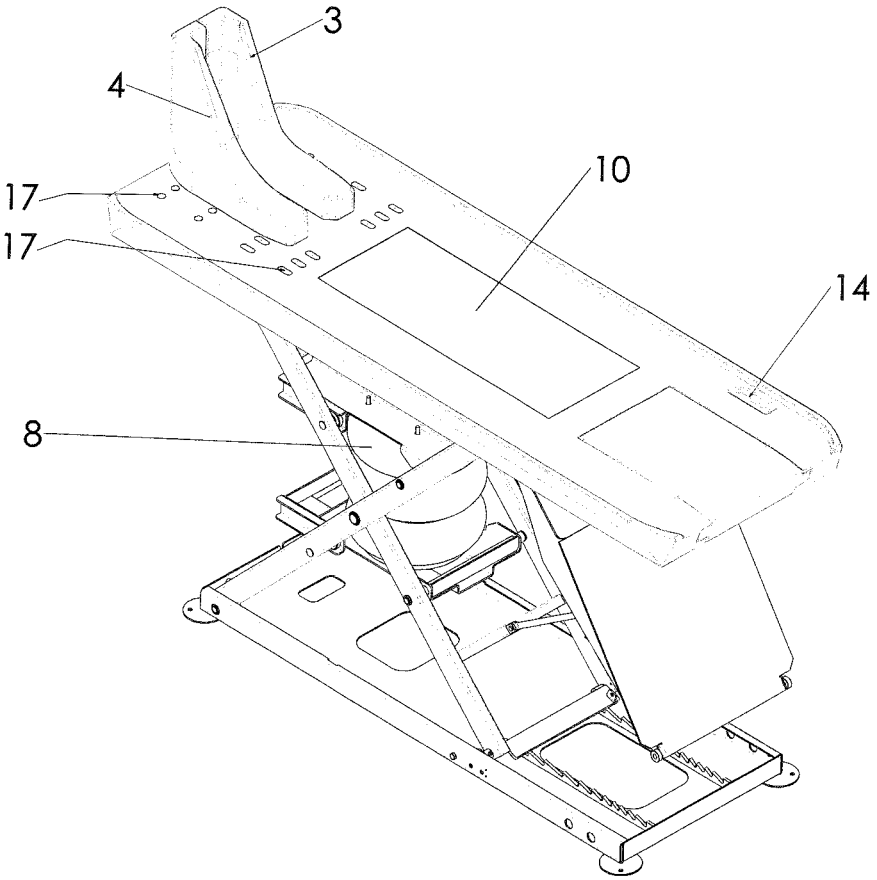
FIG. 2 is an overall view of a lift table of the invention, in a state without a wheeled vehicle.
Figure 3:
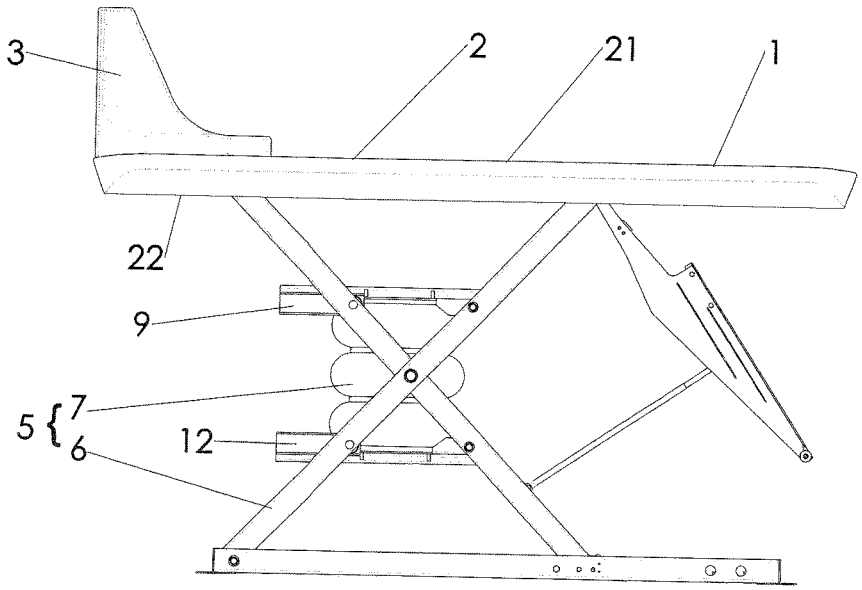
FIG. 3 is a side view of a lift table of the invention.

As mentioned above, the table 1 forming the subject matter of the invention is more particularly designed for repairing and maintaining wheeled vehicles 20 with two wheels, namely, in particular electric or hybrid motorcycles.

In known manner, this table 1 comprises a table platform 2 surmounted by a wheel clamp 3 comprising two opposing jaws 4, between which one of the wheels of the vehicle 20 is suitable for being inserted when the vehicle 20 is in the state of being arranged on the table platform 2, and a device 5 for driving upwards and downwards movement of said table platform 2. In general, it is the front wheel of the vehicle 20 that is clamped between the jaws 4 of the clamp 3.

In characteristic manner of the invention, the table platform 2 and at least the surface of the wheel clamp 3 are made out of electrically-insulating material. In the example shown, the clamp is made entirely out of electrically-insulating material. The term "electrically-insulating material" refers to a material that does not conduct electricity and that may comprise one or more materials that do not conduct electricity. In general, the non electrically-conductive material(s) constituting the electrically-insulating material is/are synthetic material(s) selected from a group made up of polyolefins, polyamides, vinyl polymers, and polyesters. Thus, these materials may be high- or medium-density polyethylene, polyvinylidene fluoride, polypropylene homopolymer, acrylonitrile butadiene styrene, polyvinylchloride, polyamide, polybutylene terephthalate, or polyethylene terephthalate.

In the example shown, the platform 2 of the lift table is made of high-density polyethylene, as are the jaws 4 of the clamp. The use of synthetic materials of the above-mentioned type for the jaws 4 of the clamp further confers on said jaws a certain amount of resilience making it possible to hold the wheel of the vehicle 20 between the jaws 4 of the clamp merely by resilient clamping, thus simplifying the design of the lift table.

In the example shown, the table platform 2 is a molded part made using rotational molding. The same applies for each jaw 4. At its end opposite from its end provided with the clamp, the table platform 2 is provided with a pivotable, slidable, or removable hatch 18. This hatch 18 is made of the same material as the rest of the table platform 2. In this embodiment, each jaw 4 is generally L-shaped with the horizontal arm of the L-shape being fastened to the top face of the table, by a rotary knob 15 projecting from the bottom of the horizontal arm, this knob 15 being inserted into a hole 17 or slot in the table top and being locked inside the slot, by turning.

This horizontal arm of the L-shape further includes, on its bottom face, a centering stud 16 suitable for cooperating with a hole 17 in the table top. By means of this design for the jaws 4 of the clamp, the jaws 4 of the clamp 3 are mounted on the table top 2 in removable manner. Since the table top 2 includes several series of holes or slots, it is thus possible to modify the position of each jaw 4, in order to provide positioning that is variable along the longitudinal axis of the table top 2 and/or spacing between the jaws 4 of the clamp 3 that is adjustable. Markings on the table top may help to position the jaws, making it easier to find the desired spacing and the desired longitudinal position. It should be observed that the longitudinal axis of the top is taken in the travel direction of the vehicle on the surface of said top, which corresponds to the long length of the table top.

In a variant that is not shown, the table top includes a plate, the jaws of the clamp may be mounted on said plate of the table top, the plate being slidable until it reaches a position outside the table top in a direction that is parallel to the plane of the table top. The jaws of the clamp of the table top may be removed by the operator during removal of the wheel, and thereby enabling the table top to be opened to pass the wheel.

Figure 4:
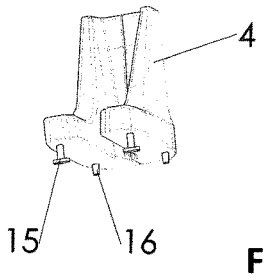
FIG. 4 is a detailed view of the clamp jaws.

In the example shown, at least some of the zones facing the vertical arms of the L-shaped jaws converge towards the table top 2, in order to form a funnel or V-shape, as shown in FIG. 4.

In the example shown, each L-shaped part of the jaw further includes, on the inside of the vertical arm of the L-shape and facing the other L-shape, a lateral projection forming an abutment, referred to as a "wheel-stop". In the examples shown, each abutment is made integrally with a jaw. This simplifies the assembly.

Naturally, these parts forming an abutment could be made separately from the jaws in the form of separate parts, or they could be made integrally with the table top.

Beside the top face 21 for receiving the vehicle 20, the table top 2 presents a "middle" longitudinal strip 10 corresponding to the tread surface of the vehicle 20 shaped to form a non-slip surface. The non-slip means may therefore be formed by elements projecting from the table top, which may be made integrally with the table top or be in the form of separate elements fitted thereto.

As mentioned above, the table 1 is a lift table that includes a device 5 for driving upwards and downwards movement of the table top 2. This device 5 for driving upwards and downwards movement of the table top 2 includes means 6 for raising the table top 2, associated with at least one pneumatic actuator 7.

In the example shown, the raising means 6 comprise two pairs of arms 61, 62. These pairs of arms are arranged facing each other in parallel manner. Each pair of arms comprises two arms 61, 62 connected to each other by a pivot connection 13. Each of the arms 61, 62 of each pair of arms, referred to as scissor arms, extends between the bottom face 22 of the table top 2 and a base 11 that is positioned in register with the table top 2. In this embodiment, the base 11 is present in the form of a simple horizontal rectangular frame.

For each pair of arms, one of the arms of the pair of arms is pivotally coupled to the base, while the other arm is pivotally and slidably coupled to the base.

In addition, for each pair of arms, one of the arms is pivotally coupled to the table top, while the other arm is pivotally and slidably coupled to the table top.

Pivoting always takes place about an axis that is parallel to the axis of the pivotal connection between the arms of a pair of arms.

In order to open and close the scissors formed by each pair of arms, the lift table 1 includes a pneumatic actuator 7 formed in this embodiment by an air cushion 8 extending in the inflated state on either side, i.e. both above and below the pivot connection 13 of the arms 61, 62 of each pair of arms.

This air cushion 8 is sandwiched between two supports, such as the plate or frame, one of which, referenced 9 in the figures, extends above the pivot connection 13, and the other one of which, referenced 12 in the figures, extends below the pivot connections 13.

In the example shown, these supports are formed by plates. For each pair of arms, each plate is coupled to one of the arms of the pair of arms by a pivot connection of axis that is parallel to the pivot connection 13 connecting together the arms of the pair, and is coupled to the other arm of the pair of arms by a pivot connection of axis that is parallel to the pivot connection 13 connecting together the arms of the pair, the portion of this pivot connection coupling the plate to the arm of the pair of arms being mounted to slide along a "longitudinal" edge of the plate.

By means of this mounting, inflating and deflating the air cushion drives upwards and downwards movement respectively of the table top 2.

Finally, to finish off the assembly, beside the top face 21 for receiving the vehicle 20, the table top 2 presents at least one housing 14 formed by an opening made in said table top 2.

In the example shown, the housing may serve to receive tools and/or spare parts.

Such a table is used as follows: with the table top in the low position, the wheeled vehicle is brought onto the table, and its front wheel is inserted between the jaws of the clamp, which ensures said front wheel is held by resilient clamping.

By inflating the air cushion that is connected to a source of air under pressure, the table top is raised to the desired height. The operator acts on the vehicle, and then proceeds to lower the table top by deflating the cushion and removing the vehicle from the table top by rolling it along said table top.

The invention claimed is:

1. A lift table for repairing and maintaining a two-wheeled vehicle, said lift table comprising;

a table top surmounted by a wheel clamp comprising two opposing jaws, between which one of the wheels of the vehicle is suitable for being clamped when the vehicle is in the state of being arranged on the table top, wherein said table top includes a series of mounting holes for each of said two opposing jaws, with said mounting holes being arranged both longitudinally and horizontally, such that each jaw can be mounted downwardly into said mounting holes via a centering stud on each jaw in order to provide positioning that is both variable along a longitudinal axis of the table top as well as horizontally between said jaws, and a device for driving upwards and downwards movement of said table top;

wherein the table top and at least surfaces of the two opposing jaws of the wheel clamp are made out of electrically-insulating material.

2. The lift table according to claim 1, wherein the electrically-insulating material of the jaws of the wheel clamp is an elastically-deformable material in order to enable the wheel to be held between the jaws of the wheel clamp by resilient clamping.

3. The lift table according to claim 1, wherein the jaws of the wheel clamp are mounted on said table top in removable manner.

4. The lift table according to claim 1, wherein beside a top face for receiving the vehicle, the table top has a longitudinal strip positioned in middle of said table top configured to corresponding to a tire tread of the vehicle to provide a non-slip surface.

5. The lift table according to claim 1, wherein the electrically-insulating material constituting the table top or the wheel clamp is selected from a group made up of polyolefins, polyamides, vinyl polymers, and polyesters.

6. The lift table according to claim 1, wherein the table top and the jaws of the wheel clamp are each molded parts made using rotational molding or thermoforming.

7. The lift table according to claim 1, wherein the device for driving upwards and downwards movement of said table top includes means for raising the table top associated with at least one pneumatic actuator.

8. The lift table according to claim 7, wherein the means for driving upwards and downwards movement of said table top comprise at least one pair of arms, connected together by a pivot connection, the arms of each pair of arms each extending between an under face of the table top and a base that is positioned in register with the table top, and in that the pneumatic actuator is an air cushion extending in the inflated state on either side both above and below the pivot connection of the arms of the at least one pair of arms.

9. The lift table according to claim 1, wherein beside a top face for receiving the vehicle, the table top presents at least one housing formed by an opening made in said table top.

* * * * *